US005134787A

United States Patent [19]

Sprenger

[11] Patent Number: 5,134,787

[45] Date of Patent: Aug. 4, 1992

[54] CATALYTIC DRYER

[75] Inventor: Robert A. Sprenger, Felton, Calif.

[73] Assignee: Heron Technologies, Inc., Campbell, Calif.

[21] Appl. No.: 534,426

[22] Filed: Jun. 6, 1990

[51] Int. Cl.[5] ..... F26B 5/04

[52] U.S. Cl. ..... 34/16; 34/27; 34/32; 34/79

[58] Field of Search ..... 34/18, 41, 155, 156, 34/79, 51, 16, 27, 32; 118/61, 58

[56] References Cited

U.S. PATENT DOCUMENTS

| | | | |
|---|---|---|---|
| 3,183,604 | 5/1965 | Stauffer | 34/18 |
| 3,551,189 | 12/1970 | Gray, Jr. et al. | 118/50 |
| 3,710,756 | 1/1973 | Goyffon | 118/61 |
| 4,343,096 | 8/1982 | Bergland | 34/47 |
| 4,475,294 | 10/1984 | Hendricks | 34/79 |
| 4,694,586 | 9/1987 | Reznik | 34/1 |
| 4,702,892 | 10/1987 | Betz | 422/171 |
| 4,867,949 | 9/1989 | Betz | 422/171 |

*Primary Examiner*—Henry Bennett

*Attorney, Agent, or Firm*—Fliesler, Dubb, Meyer & Lovejoy

[57] ABSTRACT

A dryer apparatus and a drying method are set forth for drying an object coated with a solvent which volatilizes to form a VOC. The object is fed through an enclosure. It is heated to volatilize the VOC while it is in the enclosure. A catalytic oxidation unit is provided which oxidizes substantially all VOCs which flow through it. A VOC containing first gas from the enclosure is introduced to an upstream end of a catalytic oxidation zone in the catalytic oxidation unit. A substantially VOC free second gas is led away from a downstream end of the catalytic oxidation zone. Heat is exchanged between the hot second gas and the first gas. The first gas is pumped from a first location in the enclosure and impelled into and through the oxidation unit. A sufficient portion of the second gas is impelled into the surrounding atmosphere to maintain a pressure below that of the surrounding atmosphere within both the oxidation unit and the dryer enclosure.

37 Claims, 1 Drawing Sheet

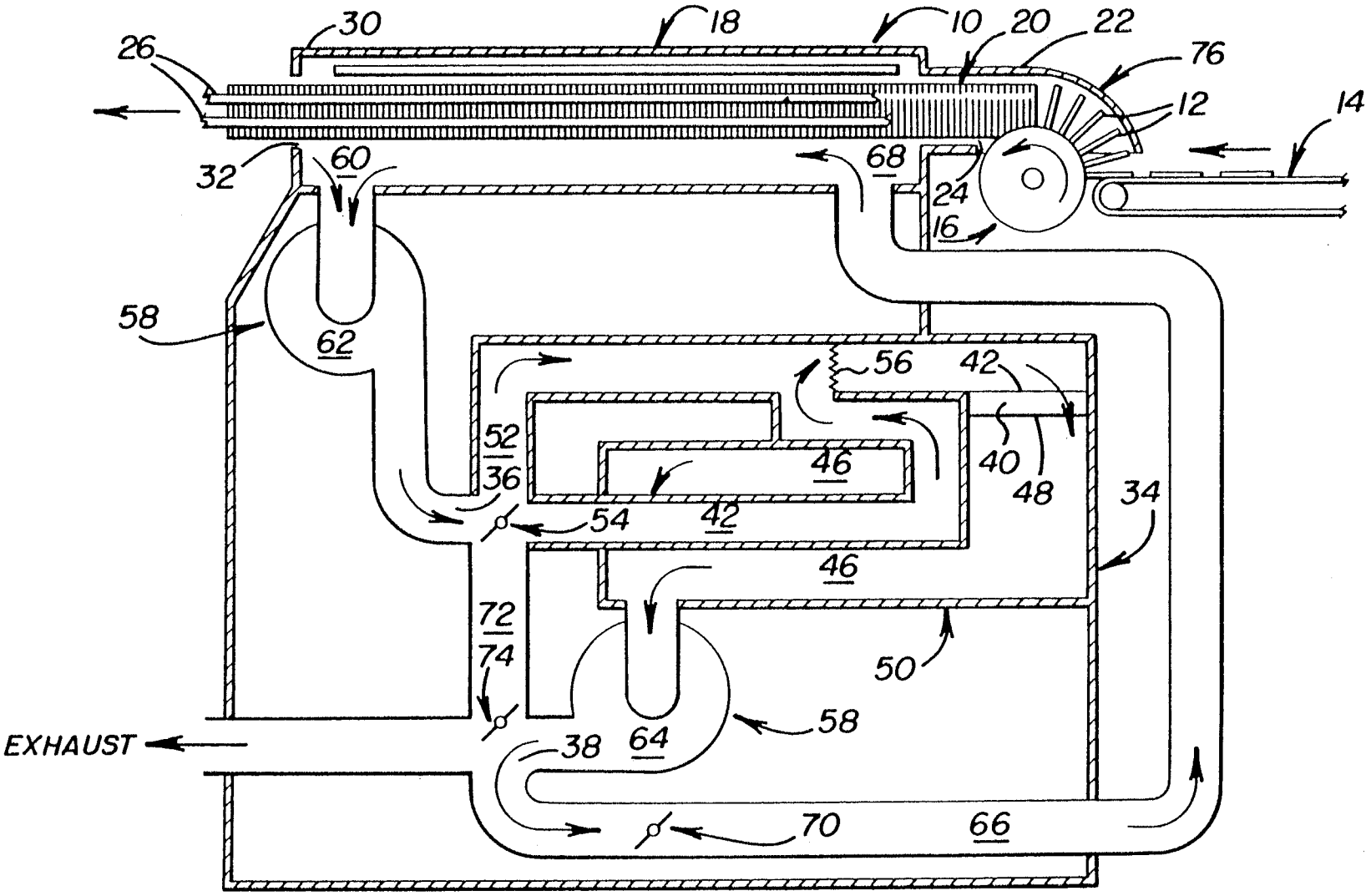
14
76
12
22
20
10
18
30
26
32
60
62
58
24
16
68
56
42
40
48
34
46
46
42
54
52
36
50
58
64
38
72
74
66
70
EXHAUST

CATALYTIC DRYER

TECHNICAL FIELD

The present invention relates to a dryer apparatus, in a specific embodiment to a can closure dryer apparatus of the nature used to dry closures after a solution of an elastomer in a volatile organic solvent, has been coated along the peripheries of the closures. More specifically, the invention relates to a catalytic oxidation unit and pumping system which eliminates the volatile organic compounds (VOCs) which are volatilized in the dryer.

BACKGROUND OF THE INVENTION

In commercial operations the closures of cans are attached to the cylindrical bodies of the cans by a crimping operation wherein the ends of the cylindrical bodies are forced in sealing relation against an elastomeric gasket which has been deposited along the rims of the end closures of the cans. To accomplish this a ring of elastomer (which is dissolved in a solvent) is placed along the periphery of one side of the can closure, namely, what will become the infacing side of the can closure. The elastomer is dried to eliminate solvent. The rim of the cylindrical can body is brought up against the closure and, under suitable temperature and pressure conditions, the closure is double seemed to the can body. The ring of elastomeric sealant which remains after the solvent has been driven off provides the seal between the can body and the closure. Water suspended elastomers can be utilized in which case the problem of getting rid of VOCs is either greatly reduced or eliminated. However, it is often desirable to utilize organic solvents, for example toluene or cyclohexane, since these allow very uniform deposition of sometimes different, and for some purposes better, elastomers and since such solvents are more readily vaporized and driven away from the can closures by heat. However, this introduces a problem of getting rid of the resulting volatilized solvents, i.e., the VOCs, in an environmentally acceptable manner.

In accordance with prior art procedures the volatile organic solvents which are volatilized during the drying of can closures have been allowed to escape into the air of the workplace and have then been absorbed or otherwise disposed of by cycling the workplace air, often the entire volume within a large factory, through an appropriate VOC removing stage. Since the factories have generally not been sealed environments this has led to a significant escape of VOCs into the surrounding atmosphere. As a result, there has been increasing movement towards legislation which would ban the use of organic solvents in canmaking operations. But, as pointed out above the use of organic solvents can be very advantageous. Accordingly, it would be highly desirable if a procedure could be developed for the canmaking industry which would allow volatile organic solvents to be utilized but would at the same time effectively protect not only the external environment, but also the environment within a factory wherein workers can be exposed to breathing such potentially hazardous chemicals.

The catalytic oxidation of VOCs to remove them from the atmosphere is a well known process. However, such systems have not been available for addressing the VOC problems of the canmaking industry. Indeed, it does not seem that any industry has provided heated dryers for driving off VOCs which have utilized catalytic oxidation units to eliminate the VOCs volatilized in the dryers without their being allowed to escape into the atmosphere. Thus, such systems have generally been applied only to abate the VOCs which escape from various apparatus into the atmosphere. That is, such catalytic oxidation systems have not been, generally, applied to closed drying systems. Representative of such systems are those shown in Guyffon, U.S. Pat. No. 3,710,756, issued Jan. 16, 1973 which shows gathering solvent vapor that evaporates from enamel into the surrounding atmosphere (an oven is provided to cure the enamel after the solvent has been volatilized), which enamel is used to coat wires and catalytically combusting it and Bergland, U.S. Pat. No. 4,343,096 and Henricks, U.S. Pat. No. 4,475,294 which control the emission of solvent by oxidizing the solvent. Also, of interest are Betz, U.S. Pat. Nos. 4,702,892 and 4,867,949 which disclose catalytic oxidation devices.

The present invention is directed to overcoming one or more of the problems as set forth above.

DISCLOSURE OF THE INVENTION

In accordance with an embodiment of the present invention an improvement is provided in a dryer apparatus which is useful for drying objects which have been coated with an organic solvent containing liquid. Such dryer apparatus generally have an enclosure having an entrance and an exit with an object or series of objects being introduced into the entrance. Within the enclosure the object or objects are heated to drive off the solvent whereby the solvent is volatilized to form VOCs. The solvent free object or objects then leave via the exit. The improvement of the present invention comprises a catalytic oxidation unit having a catalytic oxidation zone which is adapted to oxidize substantially all VOCs which flow through it into water and carbon dioxide. An inlet gas conduit serves to transfer a VOC containing first gas to an upstream end of the catalytic oxidation zone. An outlet gas conduit leads from a downstream end of the catalytic oxidation zone to an outlet. A heat exchange region is provided whereby the hot outlet gas conduit is in heat exchange relation with the inlet gas conduit. A pumping system serves for drawing the first gas from a first location in the enclosure and for impelling it into the inlet of the catalytic oxidation unit and through the unit and for impelling the second gas out of the outlet of the oxidation unit. A sufficient portion of the second gas is impelled into the surrounding atmosphere to maintain a pressure below that of the surrounding atmosphere within both the oxidation unit and the dryer enclosure.

In accordance with another embodiment of the present invention a method is set forth of substantially eliminating VOCs which are vaporized during the drying of an object or objects, for example, can closures, in an enclosure through which the object or objects, which have been coated with an organic solvent containing liquid which forms a VOC on being volatilized, are passed and in which the object or objects are heated to volatilize the VOC. The method comprises conducting a first VOC containing gas from a first location in the enclosure to a catalytic oxidation zone wherein substantially all of the VOCs are converted into water and carbon dioxide. Heat is transferred from the substantially VOC free effluent from the oxidation zone to the incoming gas. Sufficient of the effluent gas is pumped into the atmosphere to maintain a pressure below that of the surrounding atmosphere within both the oxidation unit and the dryer enclosure.

Operation in accordance with the present invention allows the use of volatile organic solvents to deposit elastomers on can closures. This allows a wide range of elastomers to be utilized and allows them to be very uniformly distributed about the peripheries of closures. Furthermore, due to their relatively low heats of vaporization the volatile organic solvents can be more readily removed than can water, which can alternatively be used to suspend the elastomer. The unit operates with a negative internal pressure whereby escape of VOCs to the surrounding atmosphere is virtually eliminated. And, because of the negative pressure the surrounding atmosphere near the entrance and exit of the dryer enclosure is drawn into the enclosure whereby VOCs in the area of the entrance and exit are catalytically oxidized. All of this provides a very advantageous alternative to cycling all of the air in a room or factory through a VOC abatement apparatus. And, all of this can operate with the very high throughput of closures that must be handled in a commercial canmaking operation and can be readily retrofitted to existing can closure dryer apparatus. Furthermore, the invention has use outside of the can making industry in that the objects being dried need not be closures. For example, it can be used to dry automobiles or equipment enclosures after they have been sprayed with paint. Thus, although for convenience and in accordance with a preferred embodiment of the invention it is described in detail below with respect to can closure drying apparatus, the invention is not so limited.

BRIEF DESCRIPTION OF THE DRAWING

The invention will be better understood by reference to the single figure of the drawing wherein a catalytic dryer apparatus in accordance with an embodiment of the invention is schematically illustrated.

BEST MODE FOR CARRYING OUT INVENTION

The figure illustrates an improved can closure dryer apparatus 10 which is adapted to dry can closures 12 which have been partially coated With an elastomer composition which includes an organic solvent which volatilizes to form a VOC. The can closures 12 can be conventionally introduced utilizing an endless belt feeder apparatus 14 and a conventional upstacker 16 which serves to feed the closures 12 into a longitudinally extending dryer enclosure 18 with the closures in the nature of a generally cylindrical stack 20 and generally being abutting against one another. The upstacker 16 can be any of those conventionally used in the art, including magnetic upstackers. After the stack of closures 20 enters an entrance end 22 of the enclosure 18 via an entrance 24 it is guided by rods 26 past longitudinally extending heaters 28 to and out of an exit end 30 of the enclosure 18 via an exit 32. Generally, the entrance 24 and the exit 32 Would be such as to provide a fairly close fit to the periphery of the stack 20. Within the enclosure 18 the solvent is vaporized to form one or more VOCs. Although the present invention works advantageously with the feeding of the stack 20 of closures 12, it is also useful if the closures 12 are otherwise fed through the enclosure 18, for example, in flat alignment on a belt. And, as mentioned previously other objects than the closures 12 can be dried in the enclosure 18 making use of the invention as described herein.

In accordance with the present invention a catalytic oxidation unit 34 is provided which has an inlet 36, an outlet 38 and a catalytic oxidation zone 40 which is adapted to oxidize substantially all VOCs which flow through it into water and carbon dioxide. An inlet gas conduit 42 leads from the inlet 36 to an upstream end 44 of the catalytic oxidation zone 40. An outlet gas conduit 46 leads from a downstream end 48 of the catalytic oxidation zone 40 to the outlet 38. A heat exchange region 50 is provided with the inlet gas conduit 42 and the outlet gas conduit 46 both passing through the heat exchange region 50 in such a manner that heat is transferred from the gas in the outlet gas conduit to the gas in the inlet gas conduit. While the heat exchange region 50 is shown schematically as merely a single concentric pipe arrangement it should be realized that a more efficient heat exchanger of the nature well known to the heat exchange art is contemplated for use in the apparatus. Thus, any appropriate heat exchange structure can be utilized.

The catalytic oxidation unit 34 can advantageously include a bypass conduit 52 for transferring at least portion of the gas in the inlet gas conduit 42 to the upstream end 44 of the catalytic oxidation zone 46 without passing that portion of the gas through the heat exchange region 50. First valve means 54 can be provided for selectively controlling the proportion of the gas from the inlet 36 which passes through the bypass conduit 52. The catalytic oxidation unit 34 can also advantageously include a preheater 56 in position to preheat the gas which enters the inlet 36 to a selected temperature before it enter the catalytic oxidation zone 40. In the particular embodiment illustrated, the preheater 56 is positioned whereat the gas passing through the inlet gas conduit 42 and the gas passing through the bypass conduit 52 both pass over the preheater 56. Gas flowing past the preheater 56 is preheated to a desired oxidation temperature, for example a temperature of about 300° F. to about 700° F., prior to its being flowed to the upstream end 44 of the catalytic oxidation zone 40. The air exiting the catalytic oxidation zone 40 is generally at a temperature in the range from 800° F. to 1400° F. and the temperature of the gas exiting the heat exchange region 50 via the outlet 38 is generally in the range from about 200° F. to about 450° F.

A pumping system 58 also forms a part of the present invention. The pumping system 58 serves for drawing the VOC containing gas from a first location 60 in the dryer enclosure 18 and for impelling this gas into the inlet 36 of the catalytic oxidation unit 34 and through the catalytic oxidation unit 34. The pumping system 58 also serves for impelling the exit gas from the catalytic oxidation zone 40 out of the outlet 38 of the catalytic oxidation unit 34. In accordance with the present invention a sufficient portion of the gas exiting the catalytic oxidation zone 40 must be impelled into the atmosphere to maintain a pressure within both the catalytic oxidation unit 34 and the dryer enclosure 18 which is below that of the surrounding atmosphere.

In the particular embodiment illustrated the pumping system 58 includes a first blower 62 connected to draw the VOC containing gas from the first location 60 in the dryer enclosure 18 and to impel the VOC containing gas into the inlet 36 of the catalytic oxidation unit 34. The particular pumping system 58 illustrated also includes a second blower 64 which is connected to draw the gas exiting the catalytic oxidation zone 40 via the heat exchange reason 50 from the outlet 38 of the catalytic oxidation unit 34. A single more powerful blower can replace the blower 64 and the blower 62 can be eliminated, if desired, but because of the pressure drop in the catalytic oxidation unit 34, particularly in the heat exchange region 50, it is preferred top utilize both the first blower 62 and the second blower 64.

It is also possible in accordance with the present invention to provide a recycle conduit 66 for recycling at least a portion of the gas from the outlet 38 of the catalytic oxidation unit 34 to a second location 68 in the dryer enclosure 18. In accordance With the preferred embodiment of the present invention the first location 60 and the second location 66 within the dryer enclosure 18 are separated by nearly the length of the dryer enclosure whereby the relatively warm air being recycled through the recycle conduit 66 helps to provide conductive heating of the stack 20 of can closures 12. The recycle conduit 66 can advantageously include a valve 70 for selectively controlling the proportion of the gas from the outlet 38 which is recycled to the dryer enclosure 18.

A conduit 72 can be provided for recycling at least a portion of the second gas from the second blower 58 to the upstream end 44 of the catalytic oxidation zone 40. In the particular embodiment illustrated the conduit 72 leads to mixing of the gas leaving the second blower 52 with gas entering the inlet 36 of the catalytic oxidation unit 34. A valve 74 can be provided for controlling the proportion of the gas exiting the second blower 64 which is intermixed with the gas entering the inlet 36 of the catalytic oxidation unit 34.

As illustrated in the figure, gas in the area of the entrance 24, specifically gas in the area of the upstacker 16, is impelled, due to the negative pressure within the dryer enclosure 18, to enter the dryer enclosure 18 and sweep with it any volatilized VOCs in the region of the entrance 24 to the dryer enclosure 18. A hood 76 may advantageously be included which covers the upstacker 16 thereby helping to retain any VOCs volatilized in the region of the entrance 24 until the negative pressure within the enclosure 18 causes them to be drawn thereinto. In the region of the exit 32 any VOCs which are close by are likewise drawn into the dryer enclosure 18. However, since the VOCs have already been carried from the first location 60 in the dryer enclosure 18 to the catalytic oxidation unit 34, there are generally little or no VOCs in the region of the exit 32.

In operation, can closures have an elastomer dissolved in an organic solvent, which on volatilization forms VOCs, deposited about their peripheries using the conventional apparatus of the industry. The closures 12 are then carried by, for example, the endless belt 14, to the upstacker 16 which picks them up, lines them up and forms them into the stack 20 and impels them into the dryer enclosure 18. At room temperature, which is essentially the temperature of the closures 12 before they enter the dryer enclosure 18, little of the solvent vaporizes. In the dryer enclosure 18 the can closures 12 are heated to a sufficient temperature so that the solvent is driven off thereby providing a significant amount of VOCs within the dryer enclosure 18. The air and VOCs in the dryer enclosure 18 are drawn from the first location 60 therein by the first blower 62 into the catalytic oxidation unit 34 wherein they are oxidized in the catalytic oxidation zone 40 to form carbon dioxide and water. The temperatures within the catalytic oxidation unit 34 may be monitored and adjusted so that optimum catalytic oxidation occurs in the catalytic oxidation zone 40. The valves 54 and 74 serve to control the temperature of the gas reaching the preheater 56. The preheater 56 can be utilized to adjust the temperature of the gas passing it so that the temperature at the upstream end 42 of the catalytic oxidation zone 40 is one which allows sufficient oxidation to take place within the catalytic oxidation zone 40 but does not lead to uncontrolled ignition. A portion of the warm gases exiting the second blower 64 can be recycled via the conduit 66 to provide more energy efficient operation of the dryer apparatus 10.

Industrial Applicability

The present invention provides a can closure dryer apparatus 10 which is useful for drying can closures 12 which have been partially coated with a liquid state form of a VOC to deposit a dissolved elastomer which serves as a gasket. Due to the presence and operation of the catalytic oxidation unit 34 and the pumping system 58, the VOCs are converted in situ to harmless chemicals, namely water and carbon dioxide, whereby personnel in the region of the can closure dryer apparatus 10 are not exposed to the VOCs. Furthermore, the necessity for treating large quantities of air, for example, the air in an entire factory, which has a relatively low content of VOCs in it to remove the VOCs is eliminated or at least greatly alleviated. And, the invention is such that retrofitting of existing apparatus is possible.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That Which Is Claimed Is:

1. In a dryer apparatus adapted to dry an object which has been coated with a solvent which will volatilize to form a volatile organic compound, the apparatus having an enclosure having an entrance end defining an entrance and an exit end defining an exit, means for introducing an object coated with the solvent into said entrance and means for heating said object to a drying temperature within said enclosure to thereby volatilize the solvent to form the volatile organic compound; an improvement comprising:

a catalytic oxidation unit having an inlet, an outlet, a catalytic oxidation zone adapted to oxidize substantially all volatile organic compounds which flow therethrough into water and carbon dioxide, an inlet gas conduit leading from, and adapted to transfer a volatile organic compound containing first gas from, said inlet to an upstream end of said catalytic oxidation zone, an outlet gas conduit leading from, and adapted to transfer a volatile organic compound substantially free second gas from, a downstream end of said catalytic oxidation zone to said outlet and a heat exchange region, said inlet and outlet gas conduits passing through said heat exchange region in such a manner that heat is transferred from said second gas to said first gas; and a pumping system for drawing said first gas from a first location in said enclosure and for impelling said first gas into said inlet of said catalytic oxidation unit and through said unit and for impelling said second gas out of said outlet of said unit, a sufficient portion of the second gas being impelled into the surrounding atmosphere to maintain a pressure below that of the surrounding atmosphere within both said unit and said enclosure.

2. A dryer apparatus as set forth in claim 1, wherein said pumping system includes a first blower connected to draw said first gas from said first location in said enclosure and connected to said inlet and a second blower connected to draw said second gas from said outlet.

3. A dryer apparatus as set forth in claim 2, further including:

recycle means for recycling at least a portion of the second gas from the second blower to a second location in the enclosure.

4. A dryer apparatus as set forth in claim 3, wherein said recycle means includes means for selectively controlling the proportion of said second gas which is recycled to said enclosure.

5. A dryer apparatus as set forth in claim 4, further including:

means for recycling at least a portion of the second gas from the second blower to the upstream end of the zone.

6. A dryer apparatus as set forth in claim 5, wherein said unit further includes a bypass conduit for transferring at least a portion of said first gas to said upstream end of said zone without passing said portion through said heat exchange region.

7. A dryer apparatus as set forth in claim 6, wherein said unit further includes first valve means for selectively controlling the proportion of said first gas which passes through said bypass conduit.

8. A dryer apparatus as set forth in claim 7, wherein said unit includes a preheater positioned to preheat said first gas before it enters said zone.

9. A dryer apparatus as set forth in claim 8, wherein said inlet gas conduit flows said first gas past said preheater where it is preheated to a desired oxidation temperature prior to transferring said first gas to said upstream end of said zone.

10. A dryer apparatus as set forth in claim 1, further including:

recycle means for recycling at least a portion of the second gas to a second location in the enclosure.

11. A dryer apparatus as set forth in claim 10, wherein said recycle means includes means for selectively controlling the proportion of said second gas which is recycled to said enclosure.

12. A dryer apparatus as set forth in claim 11, wherein said unit further includes a bypass conduit for transferring at least a portion of said first gas to said upstream end of said zone without passing said portion through said heat exchange region.

13. A dryer apparatus as set forth in claim 12, wherein said unit further includes first valve means for selectively controlling the proportion of said first gas which passes through said bypass conduit.

14. A dryer apparatus as set forth in claim 13, wherein said unit includes a preheater positioned to preheat said first gas before it enters said zone.

15. A dryer apparatus as set forth in claim 14, wherein said inlet gas conduit flows said first gas past said preheater where it is preheated to a desired oxidation temperature prior to transferring said first gas to said upstream end of said zone.

16. A dryer apparatus as set forth in claim 1, wherein said unit further includes a bypass conduit for transferring at least a portion of said first gas to said upstream end of said zone without passing said portion through said heat exchange region.

17. A dryer apparatus as set forth in claim 16, wherein said unit further includes first valve means for selectively controlling the proportion of said first gas which passes through said bypass conduit.

18. A dryer apparatus as set forth in claim 17, wherein said recycle means includes means for selectively controlling the proportion of said second gas which is recycled to said enclosure.

19. A dryer apparatus as set forth in claim 18, wherein said unit includes a preheater positioned to preheat said first gas before it enters said zone.

20. A dryer apparatus as set forth in claim 19, wherein said inlet gas conduit flows said first gas past said preheater where it is preheated to a desired oxidation temperature prior to transferring said first gas to said upstream end of said zone.

21. A dryer apparatus as set forth in claim 1, wherein said unit includes a preheater positioned to preheat said first gas before it enters said zone.

22. A dryer apparatus as set forth in claim 21, wherein said inlet gas conduit flows said first gas past said preheater where it is preheated to a desired oxidation temperature prior to transferring said first gas to said upstream end of said zone.

23. A dryer enclosure as set forth in claim 1, wherein a plurality of said objects are fed in following relation into and through said enclosure and wherein said objects are can closures.

24. A dryer apparatus as set forth in claim 23, wherein said plurality of can closures is in the form of a cylindrical stack fed into the enclosure by an upstacker and wherein said entrance and exit fit closely adjacent a periphery of said stack.

25. A dryer apparatus as set forth in claim 24, further including:

a hood extending outboard of said enclosure adjacent said entrance, said hood being adapted to maintain volatile organic compounds in the vicinity of said entrance for being drawn therein and into said enclosure.

26. A dryer apparatus as set forth in claim 25, further including:

recycle means for recycling at least a portion of the second gas to a second location in the enclosure.

27. A dryer apparatus as set forth in claim 26, wherein said recycle means includes means for selectively controlling the proportion of said second gas which is recycled to said enclosure.

28. A dryer apparatus as set forth in claim 27, wherein said recycle means includes means for selectively controlling the proportion of said second gas which is recycled to said enclosure.

29. A dryer apparatus as set forth in claim 28, wherein said unit further includes a bypass conduit for transferring at least a portion of said first gas to said upstream end of said zone without passing said portion through said heat exchange region.

30. A dryer apparatus as set forth in claim 29, wherein said unit further includes first valve means for selectively controlling the proportion of said first gas which passes through said bypass conduit.

31. A dryer apparatus as set forth in claim 30, wherein said unit includes a preheater positioned to preheat said first gas before it enters said zone.

32. A dryer apparatus as set forth in claim 31. wherein said inlet gas conduit flows said first gas past said preheater where it is preheated to a desired oxidation temperature prior to transferring said first gas to said upstream end of said zone.

33. A method of substantially eliminating a volatile organic compound vaporized during the drying of an object in an enclosure in which the object is heated to volatilize the volatile organic compound, comprising:

conducting a first gas which contains a volatile organic compound from a first location in the enclosure to an inlet to a catalytic oxidation unit having a catalytic oxidation zone adapted to oxidize substantially all volatile organic compounds which flow therethrough into water and carbon dioxide, an inlet gas conduit leading from, and adapted to transfer the first gas from, said inlet to an upstream end of said catalytic oxidation zone, an outlet gas conduit leading from, and adapted to transfer a volatile organic compound substantially free second gas from, a downstream end of said catalytic oxidation zone to an outlet from said unit and a heat exchange region, said inlet and outlet gas conduits passing through said heat exchange region in such a manner that heat is transferred from said first gas to said second gas; and pumping sufficient of the second gas into the atmosphere to maintain a pressure below that of the surrounding atmosphere within both said unit and said enclosure.

34. A method as set forth in claim 33, further including:

recycling at least a portion of the second gas to a second location in the enclosure.

35. A method as set forth in claim 34, further including:

bypassing at least a portion of said first gas to said upstream end of said zone without passing said portion through said heat exchange region.

36. A method as set forth in claim 35, further including:

preheating said first gas to a desired oxidation temperature before it enters said zone.

37. A method as set forth in claim 33, wherein a plurality of said objects are passed in following relation through said enclosure and wherein said objects are can closures.

* * * * *